United States Patent [19]

Zimmerman et al.

[11] Patent Number: 4,936,139

[45] Date of Patent: Jun. 26, 1990

[54] DOWN HOLE METHOD FOR DETERMINATION OF FORMATION PROPERTIES

[75] Inventors: Thomas H. Zimmerman; Julian J. Pop, both of Houston; Joseph L. Perkins, Sugar Land, all of Tex.

[73] Assignee: Schlumberger Technology Corporation, Houston, Tex.

[21] Appl. No.: 377,694

[22] Filed: Jul. 10, 1989

Related U.S. Application Data

[62] Division of Ser. No. 248,867, Sep. 23, 1988, Pat. No. 4,860,581.

[51] Int. Cl.[5] ..... E21B 49/10

[52] U.S. Cl. ..... 73/155; 175/40

[58] Field of Search ..... 73/38, 151, 152, 155; 166/100, 191, 250, 264; 175/40, 48, 50, 59

[56] References Cited

U.S. PATENT DOCUMENTS

| | | | |
|---|---|---|---|
| 2,511,759 | 6/1950 | Williams | 166/100 |
| 2,607,222 | 8/1952 | Lane | 73/155 |
| 2,982,130 | 5/1961 | McMahan | 73/155 |
| 3,011,554 | 12/1961 | Desbrandes et al. | 166/100 |
| 3,530,933 | 9/1970 | Whitten | 166/100 |
| 3,577,781 | 5/1971 | Lebourg et al. | 73/152 |
| 3,577,782 | 5/1971 | Aitken | 73/155 |
| 3,577,783 | 5/1971 | Whitten et al. | 73/152 |
| 3,611,799 | 10/1971 | Davis | 73/155 |
| 3,653,436 | 4/1972 | Anderson et al. | 166/100 |
| 3,677,080 | 7/1972 | Hallmark | 73/155 |
| 3,677,081 | 7/1972 | Newton et al. | 73/155 |
| 4,210,018 | 7/1980 | Brieger | 73/155 |
| 4,423,625 | 1/1984 | Bostic, III et al. | 166/250 |
| 4,434,653 | 3/1984 | Montgomery | 73/155 |
| 4,677,849 | 7/1987 | Ayoub et al. | 73/155 |
| 4,779,200 | 10/1988 | Bradbury et al. | 73/155 |

FOREIGN PATENT DOCUMENTS

| | | |
|---|---|---|
| 551888 | 1/1986 | Australia . |
| 0046651 | 3/1982 | European Pat. Off. . |
| 622971 | 7/1978 | U.S.S.R. . |
| 2172630 | 9/1986 | United Kingdom . |
| 2172671 | 9/1986 | United Kingdom . |

*Primary Examiner*—Hezron E. Williams
*Assistant Examiner*—Kevin D. O'Shea
*Attorney, Agent, or Firm*—Henry N. Garrana; Frederic C. Wagret

[57] ABSTRACT

The apparatus of the present invention relates to a down hole tool capable of extraction of valid samples and making pressure measurements useful in calculating formation permeability. The tool incorporates the features of a straddle packer to allow formation fluid specimens to be taken at large flow rates without depressing the pressure below the formation fluid bubble point. When used in combination with a pressure probe the tool is used to obtain meaningful permeability readings in a larger radius area than previously permitted with known designs. Additionally, the apparatus of the present invention allows flow control during the creation of the pressure pulse which enhances extraction of valid samples and the permeability determination. The apparatus may be modularly constructed so that in a single descent of the tool, a pressure profile of the zone of interest can be made, a fluid analysis can be made at each station, multiple uncontaminated fluid samples can be withdrawn at pressures above the bubble point, local vertical and horizontal permeability measurements can be made at each station, a packer module can be set at a location dictated by previous measurements and a large scale pressure build up test can be performed.

7 Claims, 2 Drawing Sheets

DOWN HOLE METHOD FOR DETERMINATION OF FORMATION PROPERTIES

This is a Division of Application Ser. No. 248,867 filed Sept. 23, 1988, U.S. Pat. No. 4,860,581.

FIELD OF THE INVENTION

The field of this invention relates to down hole tools particularly those adaptable for use in measuring formation permeability, pressure and taking formation fluid samples.

BACKGROUND OF THE INVENTION

In the past, down hole tools have been used to obtain formation fluid samples. These fluids were analyzed by flowing them through a resistivity test chamber. The acidity and temperature of the fluid was also measured.

Down hole sampling tools were suspended by a wireline and lowered into a bore hole. A pair of packers mounted to the tool isolated an interval in the bore hole when expanded into sealing contact with the bore hole wall. Fluid was removed from the isolated interval between the packers, through an opening in the tool, and its resistivity was measured. The resistivity measurement was sent to the surface by a wire line and when the resistivity became constant, indicating that formation fluids uncontaminated by drilling mud components were being withdrawn into the tool, the withdrawn fluids were directed into a separate chamber where the redox potential, acidity and temperature of the fluids were measured. Those results were also sent to the surface by wire line. Depending on the test results, the sample was either retained in a chamber or pumped back into the bore hole. If the sample was rejected, the packers were deflated and the tool shifted to a different position in the bore hole for further sampling. This procedure was repeated until all the sample chambers in the tool were filled with the required samples. Such a sampling tool is illustrated in U.S. Pat. No. 4,535,843 entitled Method and Apparatus for Obtaining Selected Samples of Formation Fluids. Since the sampling apparatus in the '843 patent had a purpose solely to obtain formation fluids for analysis and was not used for measuring formation permeability, the sample flow rate into the apparatus was of no concern.

In the past, formation fluid samples were taken through a probe which extended through the bore hole wall and was generally surrounded by a sealing member made from a material compatible with the well fluids. Typically, the fluid opening in the probe was surrounded by an elastomeric annular sealing pad mounted to a support plate which was laterally movable by actuators on the tool. On the opposite side of the tool, a tool anchoring member was selectively extendable for use in conjunction with the movable sealing pad to position the tool in a manner such that the sample point was effectively sealed from well fluids.

Sampling tools used in the past contained pressure sensors. However, there were still concerns about being able to detect during the course of a testing operation whether a sample was actually being obtained and, if a sample was entering the tool, how fast the sample was being admitted to the sample chamber.

Some formation testing tools employed a "water cushion arrangement" with regard to the admission of formation fluids into the tool. As shown in U.S. Pat. No. 3,011,554, this arrangement includes a piston member which is movably disposed in an enclosed sample chamber so as to define upper and lower spaces in the chamber. Where the entrance to the sample chamber is above the piston, the upper space is initially at atmospheric pressure and the lower space is filled with a suitable and nearly incompressible fluid such as water. A second chamber or liquid reservoir which is also initially empty and having a volume equal or greater than the lower space is in flow communication with the lower filled water space by a suitable flow restriction such as an orifice. As formation fluids enter the empty upper portion of the sample chamber, the piston is progressively moved downwardly from its initial elevated position to displace water from the lower portion of the sample chamber through the orifice and into the initially empty liquid reservoir.

It can readily be seen in this device that the flow control is done by sizing the orifice through which the water from the lower space is displaced into the liquid reservoir downstream of the orifice. This arrangement does not provide for direct control of flow rate of formation fluid into the tool. Depending upon formation permeability and orifice size and initial downstream pressure from the orifice, a situation can arise in such a tool where the pressure drop in the sample line is large enough to cause gas formation when the pressure drops below the bubble point of the formation fluid. When such gas formation occurs, the tool will not yield interpretable results which can be used to determine formation permeability and non representative fluid samples are withdrawn.

Other fluid admission systems have been employed where no water cushion is used. In U.S. Pat. No. 3,653,436, formation fluids were admitted into an initially empty sample chamber. The tool contained a pressure sensor to sense the flow line pressure. The flow line pressure rises imperceptibly at an extremely low rate and it is not until a sample chamber is almost filled that any substantial increase in the measured pressure occurs. In this type of configuration, the fluid sampling rate is not controlled.

A modification of the water cushion type of sampling system is found in U.S. Pat. No. 3,859,850. In the '850 patent, selectively operable valves are opened to place the fluid admitting means into communication with a sample collecting means comprised of an initially empty first collection chamber that is randomly coupled to a vacant accessible portion of a second sample collection chamber that is itself divided by a piston member movably disposed therein and normally biased toward the entrance to the second chamber by a charge of compressed gas confined in an enclosed portion of the second chamber. As sample fluids enter the sample collecting means, the first sample chamber is initially filled before sufficient pressure is built up in the first chamber to begin moving the piston member so as to allow formation fluids to begin filling the second chamber. By observing the time required for filling the first chamber, the flow rate of the entering formation fluids can be estimated.

Once the first chamber is filled and the pressure of formation fluid equals the pressure of the compressed gas, movement of the piston into the gas filled portion of the second chamber further compresses the gas charge so as to impose a proportionally increasing back pressure on the formation fluids which can be measured to obtain a second measurement that may be used to estimate the rate at which formation fluids if any are entering the second sample chamber.

Yet other sampling devices that isolate the sample point from the well fluids at a fixed point on the formation by including a probe surrounded by a resilient seal for sampling formation fluids are described in U.S. Pat. Nos. 3,934,468, and U.K. Patent Application Nos. 2172630A and 2172631A.

In view of the significant expenses involved in drilling oil and gas wells, it is desirable to determine the fluid pressure and permeability of formations in order that the ability of the well to produce can be estimated before committing further resources to the well and at the surface. Most permeable formations are hydraulically anisotropic therefore making it desirable to measure vertical and horizontal permeability for a given formation. This is typically done by creating a pressure gradient in a zone within a selected formation and determining the fluid pressure at one or more points in the zone. The static pressure of a formation is determined at a given point in the formation by the use of a probe having a fluid communication channel between a point in the formation and a suitable pressure measuring device in the bore hole traversing the formation. The formation pressure in the vicinity of the point is changed before, during or after the static pressure measurement to create the gradient zone about that point by passing fluid into or extracting fluid from the formation In U.S. Pat. No. 2,747,401 a dual probe arrangement was illustrated where fluid was either withdrawn or pumped into the formation at one point and pressure gradient measured at another point. The measured pressure gradient was representative of the actual and relative permeability of the formation. The apparatus in the '401 patent could be used to measure variables permitting calculation of the permeabilities of the formation in several different directions thus revealing the degree of hydraulic anisotropy of the formation.

One type of commercially available tool known as RFT by the registered Trade Mark "RFT" (Repeatable Formation Tester) has been used to measure permeability although the tool finds greater application as a pressure measurement device and a sample taker. The problem with this type of tool is that for low permeabilities, the pressure drop caused by the flow at the producing probe was large and gas formation resulted when the pressure dropped below the bubble point of the formation fluid. In such instances, the test was uninterpretable. Conversely, in high permeability situations, the pressure drop was frequently too small and the pressure build up too fast to be measured effectively with commercially available pressure sensors. There have been some modifications of the basic permeability measurement tools. In one such modification, the producing probe pressure drawdown is preset at the surface at a constant value for the duration of the flow. This value can be selected so as to reduce gas formation problems and to maximize pressure amplitude. The problem is that there are no provisions for flow rate measurements nor is the sample size accurately known. Either one of these measurements is necessary to arrive at a reasonable interpretation for the horizontal permeability when the formation is isotropic or only mildly anisotropic i.e., "a" is between 1 and 100 where a=the ratio of the horizontal to the vertical permeability.

In single probe RFT tools, the permeability determined is the spherical or cylindrical permeability. In homogeneous and low anistropy formations, this is sufficient. In heterogeneous or highly anisotropic formations, additional observation probes are necessary for proper formation characterization.

The single probe devices are limited in their usefulness in determining permeability because the depth of investigation is extremely shallow (several inches) during fluid removal. Thus, the information that is gathered from this type of tool only relates to conditions very near the sample point. Such conditions may also be severely altered by the drilling and subsequent fluid invasion process.

Use of multiple probes extended the depth of investigation to a magnitude on the order of the probe spacing.

In order to obtain meaningful permeability information deeper into the formation so as to avoid the effects of drilling damage and formation invasion, the probe spacing must be significantly greater than known designs such as shown in U.S. Pat. No. 2,747,401. Known designs make probe spacing in the order of six to twelve or more feet unworkable since the fluid removal rate and therefore the magnitude of the propagated pressure pulse is limited due to the small bore hole wall area exposed with such tools.

Another way to measure permeability is to use a vertical pulse test. In a cased and cemented well, the casing packer isolates a perforated interval of casing to provide sufficient bore hole area open to flow. This allows a pressure pulse large enough to be measured with a pressure gauge. This type of measurement can only be used after the wall is cased and cemented. Channels behind the casing may alter the effective vertical spacing and therefore the measured results.

The apparatus of the present invention is designed to allow gathering of permeability data over greater depths into the formation than has been possible with prior tools. The apparatus employs a straddle packer as a component of the tool. By allowing greater surface area from which a sample of formation fluid can be taken, larger flow rates can be used and meaningful permeability data for a radius of approximately fifty to eighty feet can be obtained. Additionally, by having the ability to withdraw formation fluid at pressures above the bubble point due to the extended surface area between the packer seals, the spacing between the sample point and the pressure probe is effectively increased to a range of eight to fifteen feet and above thus permitting data collection on formation permeability for points more remote from the tool than was possible with prior designs; providing increased depth of investigation. Additionally, with use of the straddle packer, high accuracy vertical pulse tests can be done using a packer and a single probe.

Additionally, the apparatus of the present invention also employs a flow control feature to regulate the formation fluid flow rate into the tool thereby providing a constant pressure or constant flowrate drawdown on the formation face to enhance the multiprobe permeability determination. With sample flow control, it can be insured that samples are taken above the formation fluid bubble point. Samples can also be taken in unconsolidated zones. The sample flow rate can also be increased to determine the flow rates at which sand will be carried from the formation with the formation fluids.

The apparatus of the present invention can also be constructed to be flexible for doing various types of tests by constructing it in a modular method. Additionally, each module may also be constructed to have a flow line running therethrough as well as electrical and hydraulic fluid control lines which can be placed in alignment when one module is connected to the next. Thus, a tool can be put together to perform a variety of functions while still maintaining a slender profile. Such modules can contain sample chambers, fluid analysis equipment, pressure measurement equipment, a hydraulic pressure system to operate various control systems within the other modules, a packer module for isolating a portion of the well bore from the formation sample point, probe modules for measuring pressure variations during formation fluid sampling and a pump out module to return to the well bore samples that are contaminated with mud cake.

SUMMARY OF THE INVENTION

The apparatus of the present invention relates to a down hole tool capable of making pressure measurements useful in calculating formation permeability. The tool incorporates the features of a straddle packer to allow formation fluid specimens to be taken at large flow rates without depressing the pressure below the formation fluid bubble point. When used in combination with a pressure probe the tool is used to obtain more meaningful permeability readings, and at greater depths of investigation than previously permitted with known designs. Additionally, the apparatus of the present invention allows flow control during the creation of the pressure pulse which enhances the permeability determination. The apparatus may be modularly constructed so that in a single descent of the tool, a pressure profile of the zone of interest can be made, a fluid analysis can be made at each station, multiple uncontaminated fluid samples can be withdrawn at pressures above the bubble point, local vertical and horizontal permeability measurements can be made at each station, a packer module can be set at a location dictated by previous measurements and a large scale pressure build up test can be performed.

DETAILED DESCRIPTION OF THE PREFERRED EMBODIMENT

The apparatus A is preferably of modular construction although a unitary tool is within the scope of the invention. The apparatus A is a down hole tool which can be lowered into the well bore (not shown) by a wire line (not shown) for the purpose of conducting formation property tests. The wire line connections to the tool as well as power supply and communications related electronics are not illustrated for the purpose of clarity. The power and communication lines which extend throughout the length of the tool are generally shown as numeral 8. These power supply and communication components are known to those skilled in the art and have been in commercial use in the past. This type of control equipment would normally be installed at the uppermost end of the tool adjacent the wire line connection to the tool with electrical lines running through the tool to the various components.

Figure 1:
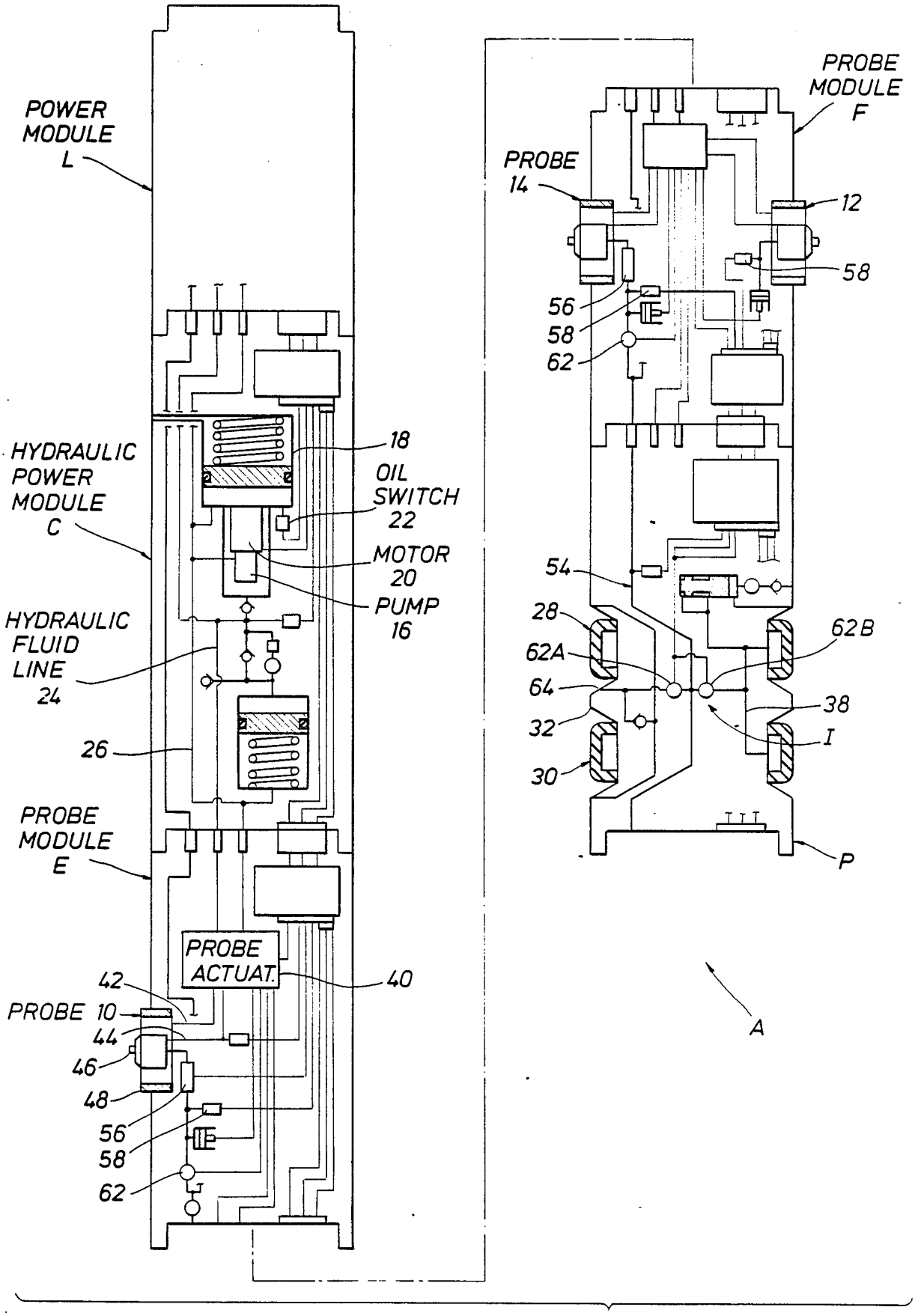
FIG. 1 is a schematic representation of the apparatus of the present invention illustrating some of the modular components which can be made a part of the apparatus.

As shown in FIG. 1, the apparatus A of the present invention has a hydraulic power module C, a packer module P and a probe module E. Probe module E is shown with one probe assembly 10 which is used for isotropic permeability tests. When using the tool to determine anisotropic permeability and the vertical reservoir structure, a multiprobe module F can be added to probe module E. Multiprobe module F has a horizontal probe assembly 12 and a sink probe assembly 14.

The hydraulic power module C includes a pump 16, reservoir 18 and a motor 20 to control the operation of the pump. A low oil switch 22 also forms part of the control system and is used in regulating the operation of pump 16. It should be noted that the operation of the pump can be controlled by pneumatic or hydraulic means without departing from the spirit of the invention.

A hydraulic fluid line 24 is connected to the discharge of pump 16 and runs through hydraulic power module C and into adjacent modules for use as a hydraulic power source. In the embodiment shown in FIG. 1, hydraulic fluid line 24 extends through hydraulic power module C into packer module P and probe module E or F depending upon which one is used. The loop is closed by virtue of hydraulic fluid line 26, which in FIG. 1 extends from probe module E back to hydraulic power module C where it terminates at reservoir 18.

The pump out module M can be used to dispose of unwanted samples by virtue of pumping the flow line 54 into the bore hole or may be used to pump fluids from the borehole into the flow line 54 to inflate straddle packers 28 and 30. Pump 92 can be aligned to draw from flow line 54 and dispose of the unwanted sample through flow line 95, as shown on FIG. 2 or may be aligned to pump fluid from the borehole (via flow line 95) to flow line 54. The pump out module M has the necessary control devices to regulate pump 92 and align fluid line 54 with fluid line 95 to accomplish the pump out procedure. It should be noted that samples stored in sample chamber modules S can also be pumped out of the apparatus A using pump out module M.

Alternatively, straddle packers 28 and 30 can be inflated and deflated with hydraulic fluid from pump 16 without departing from the spirit of the invention. As can readily be seen, selective actuation of the pump out module M to activate pump 92 combined with selective operation of control valve 96 and inflation and deflation means I, can result in selective inflation or deflation of packers 28 and 30. Packers 28 and 30 are mounted to the outer periphery 32 of the apparatus A. The packers 28 and 30 are preferably constructed of a resilient material compatible with well bore fluids and temperatures. The packers 28 and 30 have a cavity therein. When pump 92 is operational and inflation means I are properly set, fluid from flow line 54 passes through inflation/deflation means I, and through flow line 38 to packers 28 and 30.

As also shown in FIG. 1, the probe module E has probe assembly 10 which is selectively movable with respect to the apparatus A. Movement of probe assembly 10 is initiated by virtue of the operation of probe actuator 40. The probe actuator 40 aligns flow line 24 and 26 with flow lines 42 and 44. As seen in FIG. 1, the probe 46 is mounted to a frame 48. Frame 48 is movable with respect to the apparatus A and probe 46 is movable with respect to frame 48. These relative movements are initiated by controller 40 by directing fluid from flow lines 24 and 26 selectively into flow lines 42 and 44 with the result being that the frame 48 is initially outwardly displaced into contact with the bore hole wall. The extension of frame 48 helps to steady the tool during use and brings probe 46 adjacent the bore hole wall. Since the objective is to obtain an accurate reading of pressure wave propagation within the formation fluids, it is desirable to further insert probe 46 into the formation and through the built up mud cake. Thus, alignment of flow line 24 with flow line 44 results in relative displacement of probe 46 into the formation by virtue of relative motion with respect to frame 48. The operation of probes 12 and 14 is similar.

Permeability measurements can be made by a multi probe module F lowering the apparatus A into the bore hole and inflating packers 28 and 30. It should be noted that such measurements can be accomplished using the probe modules E or E and F without packer module P without departing from the spirit of the invention. The probe 46 is then set into the formation as described above. It should be noted that a similar procedure is followed when using multiprobe module F and probe module E which contain vertical probe 46 and horizontal probe 12 and sink probe 14.

Having inflated packers 28 and 30 and/or set probe 46 and/or probes 46, 12 and 14, the testing of the formation can begin. A sample flow line 54 extends from the outer periphery 32 at a point between packers 28 and 30, through adjacent modules and into the sample modules S. Vertical probe 46 and sink probe 14 allow entry of formation fluids into the sample flow line 54 via a resistivity measurement cell a pressure measurement device and a pretest mechanism. Horizontal probe 12 allows entry of formation fluids into a pressure measurement device and pretest mechanism. When using module E or E and F, isolation valve 62 is mounted downstream of resistivity sensor 56. In the closed position, isolation valve 62 limits the internal flow line volume, improving the accuracy of dynamic measurements made by pressure gage 58. After initial pressure tests are made, isolation valve 62 can be opened to allow flow into other modules. When taking initial samples, there is a high prospect that the first fluid obtained is contaminated with mud cake and filtrate. It is desirable to purge such contaminents from the sample to be taken. Accordingly, the pumpout module M is used to initially purge from the apparatus A specimens of formation fluid taken through inlet 64 or vertical probe 46 or sink probe 14 to flow line 54. After having suitably flushed out the contaminents from the apparatus A, formation fluid can continue to flow through sample flow line 54 which extends through adjacent modules such as precision pressure module B, fluid analysis module L, pump out module M (FIG. 2), flow control module N and any number of sample chamber modules S which may be attached. By having a sample flow line 54 running the longitudinal length of various modules, multiple sample chamber modules S can be stacked without necessarily increasing the overall diameter of the tool. The tool can take that many more samples before having to be pulled to the surface and can be used in smaller bores.

Figure 2:
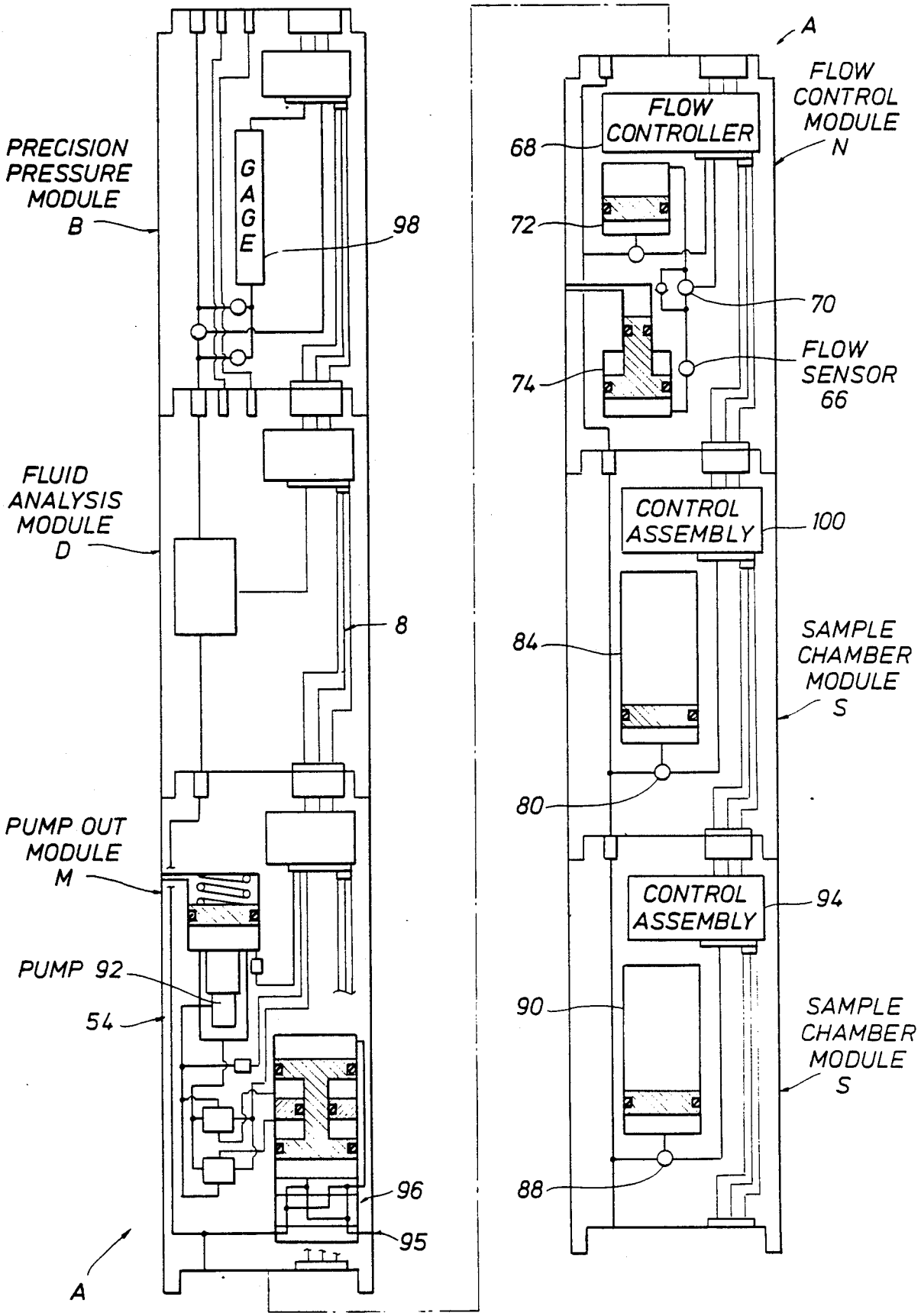
FIG. 2 is a schematic representation of additional modules which can be made part of the apparatus.

The flow control module N includes a flow sensor 66, a flow controller 68 and a selectively adjustable restriction device, typically a valve 70. A predetermined sample size can be obtained at a specific flow rate by use of the equipment described above in conjunction with reservoirs 72 and 74. Having obtained a sample, sample chamber module S can be employed to store the sample taken in flow control module N. To accomplish this, a valve 80 is opened while valves 62, 62A and 62B are held closed, thus directing the sample just taken into a chamber 84 in sample chamber module S. The tool can then be moved to a different location and the process repeated. Additional samples taken can be stored in any number of additional sample chamber modules S which may be attached by suitable alignment of valves. For example, as shown in FIG. 2, there are two sample chambers S illustrated. After having filled the upper chamber by operation of valve 80, the next sample can be stored in the lowermost sample chamber module S by virtue of opening valve 88 connected to chamber 90. It should be noted that each sample chamber module has its own control assembly, shown in FIG. 2 as 100 and 94. Any number of sample chamber modules S or no sample chamber modules can be used in a particular configuration of the tool depending upon the nature of the test to be conducted. All such configurations are within the purview of the invention.

As shown in FIG. 2, sample flow line 54 also extends through a precision pressure module B and a fluid analysis module D. The gauge 98 should preferably be mounted as close to probes 12, 14 or 46 to reduce internal piping which, due to fluid compressibility, may affect pressure measurement responsiveness. The precision gauge 98 is more sensitive than the strain gauge 58 for more accurate pressure measurements with respect to time. Gauge 98 can be a quartz pressure gauge which has higher static accuracy or resolution than a strain gauge pressure transducer. Suitable valving and control mechanisms can also be employed to stagger the operation of gauge 98 and gauge 58 to take advantage of their difference in sensitivities and abilities to tolerate pressure differentials.

Various configurations of the apparatus A can be employed depending upon the objective to be accomplished. For basic sampling, the hydraulic power module C can be used in combination with the electric power module L, probe module E and multiple sample chamber modules S. For reservoir pressure determination, the hydraulic power module C can be used with the electric power module L, probe module E and precision pressure module B. For uncontaminated sampling at reservoir conditions, hydraulic power module C can be used with the electric power module D, probe module E in conjunction with fluid analysis module L, pump out module M and multiple sample chamber modules S. To measure isotropic permeability, the hydraulic power module C can be used in combination with the electric power module L, probe module E, precision pressure module B, flow control module N and multiple sample chamber modules S. For anisotropic permeability measurements, the hydraulic power module C can be used with probe module E, multiprobe module F, the electric power module L precision pressure module B, flow control module N and multiple sample chamber modules S. A simulated DST test can be run by combining the electric power module L with packer module P and precision pressure module B and sample chamber modules S. Other configurations are also possible without departing from the spirit of the invention and the makeup of such configurations also depends upon the objectives to be accomplished with the tool. The tool can be of unitary construction as well as modular; however, the modular construction allows greater flexibility and lower cost, to users not requiring all attributes.

The individual modules may be constructed so that they quickly connect to each other. In the preferred embodiment, flush connections between the modules are used in lieu of male/female connections to avoid points where contaminants, common in a wellsite environment may be trapped.

It should also be noted that the flow control module is also adapted to control the pressure while a sample is being taken.

Use of the packer module P allows a sample to be taken through inlet 64 by drawing formation fluid from a section of the well bore located between packers 28 and 30. This increased well bore surface area permits greater flow rates to be used without risk of drawing down the sample pressure to the bubble point of the formation fluid thus creating undesirable gas which affects the permeability test results.

Additionally, as described earlier, the use of the apparatus A permits the use of multiple probes at a distance far greater than a few centimeters as disclosed in U.S. Pat. No. 2,747,401. In order to determine formation permeability unaffected by drilling damage and formation invasion, probe spacing in the neighborhood of six to twelve feet and greater is necessary. Known wire line probes present difficulties in probe spacings of the magnitudes indicated because the fluid removal rate and therefore the magnitude of the pressure pulse is limited due to the small bore hole wall area which is exposed.

Flow control of the sample also allows different flow rates to be used to determine the flow rate at which sand is removed from the formation along with formation fluids. This information is useful in various enhanced recovery procedures. Flow control is also useful in getting meaningful formation fluid samples as quickly as possible to minimize the chance of binding the wireline and/or the tool because of mud oozing onto the formation in high permeability situations. In low permeability situations, flow control is helpful to prevent drawing formation fluid sample pressure below its bubble point.

In summary, the hydraulic power module C provides the basic hydraulic power to the apparatus A. In view of the hostile conditions which are encountered downhole, a brushless DC motor may be used to power pump 16. The brushless motor may be incased in a fluid medium and include a detector for use in switching the field of the motor.

The probe module E and multiprobe module F include a resistivity measurement device 56 which distinguishes, in water based muds, between filtrate and formation fluid when the fluid analysis module L is not included in the apparatus A. The valve 62 minimizes after flow when performing permeability determinations. The fluid analysis module D is designed to discriminate between oil, gas and water. By virtue of its ability to detect gas, the fluid analysis module D can also be used in conjunction with the pump out module M to determine formation bubble point.

The flow control module N further includes a means of detecting piston position which is useful in low permeability zones where flow rate may be insufficient to completely fill the module. The flow rate may be so low it may be difficult to measure; thus, detection of piston position allows a known volumetric quantity to be sampled.

While particular embodiments of the invention have been described, it is well understood that the invention is not limited thereto since modifications may be made. It is therefore contemplated to cover by the appended claims any such modifications as fall within the spirit and scope of the claims.

We claim:

1. A multi purpose downhole method for obtaining data regarding formation fluid properties by means of a downhole tool comprising:

formation fluid pulsing by means having an inlet positioned to provide fluid communication between the formation fluids and the interior of the tool for selectively creating a pressure transient in the formation fluid zone;

sealing off a segment of the bore hole from well fluids located above and below said inlet by packer means mounted above and below said inlet; and detecting a formation pressure transient created by said pulsing means.

2. The method of claim 1 wherein said fluid pulsing step further comprises:

establishing a flow line between the formation and the tool including a flow sensing element; and selectively adjusting a restriction device mounted in said flow line to regulate the fluid flow rate.

3. The method of claim 2 wherein said formation fluid pulsing step further comprises:

establishing a first fluid communication with said flow line, and extending to the outer surface of said tool; and establishing a second fluid communication extending longitudinally through the length of a sample chamber module and in selective fluid communication with said flow line and said first fluid communication.

4. The method of claim 3 further comprising:

measuring physical properties of the formation fluid by fluid analysis means;

measuring formation fluid pressure by pressure measurement means;

establishing a third fluid communication between said second fluid communication and said fluid analysis means and said precision pressure measurement means; and selectively pumping fluid in all of said flow lines into and out of said tool.

5. A multi purpose downhole method for obtaining data regarding formation properties by means of a downhole tool comprising the steps of:

formation fluid pulsing by means having an inlet positioned to provide fluid communication between the formation fluids and the interior of the tool for selectively creating a pressure transient in the formation fluid zone;

regulating the fluid flow rate between the formation fluid and the tool in a manner as to prevent reduction of pressure of formation fluid flowing into said inlet, below its bubble point; and detecting a formation pressure transient created by said pulsing means.

6. The method of claim 5 wherein said fluid flow regulating step further comprises:

establishing a flow line between the formation and the tool including a flow sensing element and a selectively adjustable restriction device mounted in the flow line; and selectively adjusting said restriction device to regulate the fluid flow rate.

7. The method of claim 5 further comprising the steps of:

measuring physical properties of the formation fluid;

measuring the formation fluid pressure; and selectively pumping fluid out of the interior of said tool.

* * * * *